United States Patent [19]

Ferroni et al.

[11] Patent Number: 4,669,182

[45] Date of Patent: Jun. 2, 1987

[54] METHOD OF GAGING A SNAP DISC CONDITION SENSOR

[75] Inventors: C. Paul Ferroni; Jonathan L. Linton; Donald J. Schmitt, all of Mansfield, Ohio

[73] Assignee: Therm-O-Disc, Incorporated, Mansfield, Ohio

[21] Appl. No.: 783,016

[22] Filed: Oct. 2, 1985

Related U.S. Application Data

[62] Division of Ser. No. 573,018, Jan. 23, 1984, Pat. No. 4,570,148.

[51] Int. Cl.[4] ..... H01H 11/00

[52] U.S. Cl. ..... 29/622; 29/593

[58] Field of Search ..... 29/622, 593; 200/835, 200/835 A; 337/84, 94, 319, 347, 368

[56] References Cited

U.S. PATENT DOCUMENTS

| | | | |
|---|---|---|---|
| 3,636,622 | 1/1972 | Schmitt | 29/593 |
| 3,832,667 | 8/1974 | Blanton | 337/368 |
| 4,010,337 | 3/1977 | Thompson et al. | 337/319 |
| 4,079,348 | 3/1978 | Meijer et al. | 337/354 |
| 4,090,166 | 5/1978 | Burch | 29/622 |
| 4,464,828 | 8/1984 | Stoll | 29/622 |

*Primary Examiner*—Percy W. Echols

*Attorney, Agent, or Firm*—Pearne, Gordon, McCoy & Granger

[57] ABSTRACT

A bimetal snap disc thermostat is disclosed which is structured for automated assembly. Such thermostat includes a body with contact supports molded therein in a manner providing sufficient strength so that terminals can be riveted onto the contact supports after assembly. The body and contact support subassembly is structured so that it is symmetrical on opposite sides of a central axis. A disc cup is provided with axial and radial surfaces which accurately locate the disc during and after assembly. Also disclosed is a method of gaging and calibrating the thermostat automatically. Calibration of the spring force of the movable contact is accomplished by sensing the force in a given position and subsequently deforming the spring until a predetermined force exists in such predetermined position. Gaging is accomplished by deforming a projection from the movable contact arm until a predetermined uniform spacing is established between such projection and a gaging surface.

4 Claims, 10 Drawing Figures

METHOD OF GAGING A SNAP DISC CONDITION SENSOR

This is a division of application Ser. No. 573,018, filed Jan. 23, 1984 now U.S. Pat. No. 4,570,148.

BACKGROUND OF THE INVENTION

This invention relates generally to bimetal snap disc thermostats and the like, and more particularly to a novel and improved snap acting condition-sensing device and to a novel and improved method and apparatus for producing such devices.

Prior Art

Snap disc condition-sensing devices are well known. Such devices often employ bimetal snap discs which snap back and forth between two positions of stability in response to predetermined temperatures or homogeneous metal discs which snap in response to pressure. Such devices usually operate switches, but can be used to actuate valves. Examples of such devices are illustrated in U.S. Pat. Nos. 3,302,269; 3,378,656; 3,470,518; and 3,624,434.

In order to provide snap action, the discs are usually formed with a shallow curvature to create a negative spring rate so that they have a zone of instability and will snap back and forth between two positions of stability in response to predetermined conditions being sensed. When such discs are small, e.g., one-half inch in diameter, the snap travel is quite small. Therefore, it is necessary to build such devices with precision to ensure that the switch or valve operates within the snap range of the disc.

In order to compensate for variations caused by manufacturing tolerances, it has generally been customary to assemble the switch on the body of the device and thereafter carefully measure the spacing between the switch arm and a disc locating surface on the body. Such measurement is then used to establish the length of the bumper which transmits the snap action of the disc to the switch. This requires selective assembly in which bumpers of different lengths are used to compensate for manufacturing tolerances in the switch assembly.

Various systems have been used to calibrate the force of the spring arm which supports the movable contact in the switch. The accurate establishment of the spring force is important for two reasons. First, the efficient operation of the switch through repeated cycles is effected by the force between the contacts when the switch is closed. If insufficient force is available, a good connection is not provided between the switch contacts and switch deterioriation can occur prematurely. Second, since the force of the spring is transmitted to the disc when the switch is open, variations in the force applied by the switch spring arm can vary the operating condition at which the disc snaps. Therefore, it is highly desirable to provide a switch structure in which the force of the spring of the movable contact is uniform from one device to the next.

SUMMARY OF THE INVENTION

In accordance with the present invention, a novel and improved condition-sensing device is provided which can be uniformly manufactured by automated equipment to reduce the labor costs of manufacture. There are a number of aspects to this invention. In accordance with one important aspect, the switch is structured so that its manufacture can be virtually completely automated. For example, the contact supports are molded into the switch body in such a way that the contact support body assembly is symmetrical to ease the automated positioning of the assembly within the assembly equipment.

Further, the device is structured so that it can be fully assembled prior to the installation of the terminals. This is an important feature, since customer requirements often dictate that various types of terminals be assembled on a given switch device system. Since it is difficult to fully automate a system capable of installing a variety of different terminal structures, the present device is constructed and structured so that it can be completely assembled in fully automated equipment and thereafter the particular type of terminal required for a particular application can be installed without requiring the basic automated equipment to be capable of assembling a variety of different terminal structures.

In accordance with another important aspect of this invention, the device is structured so that the force of the movable contact support arm can be calibrated to a uniform value in automated equipment.

In accordance with another aspect of this invention, a novel and improved method and structure are provided for automated gaging of the switch structure with respect to the body so as to eliminate the requirement for selective assembly of bumpers having different lengths.

In accordance with still another aspect of this invention, a novel and improved disc cup is provided which is structured to axially and radially locate the disc during the assembly of the device.

These and other aspects of this invention are illustrated in the accompanying drawings, and are more fully described in the following specification.

DETAILED DESCRIPTION OF THE DRAWINGS

Figure 1:
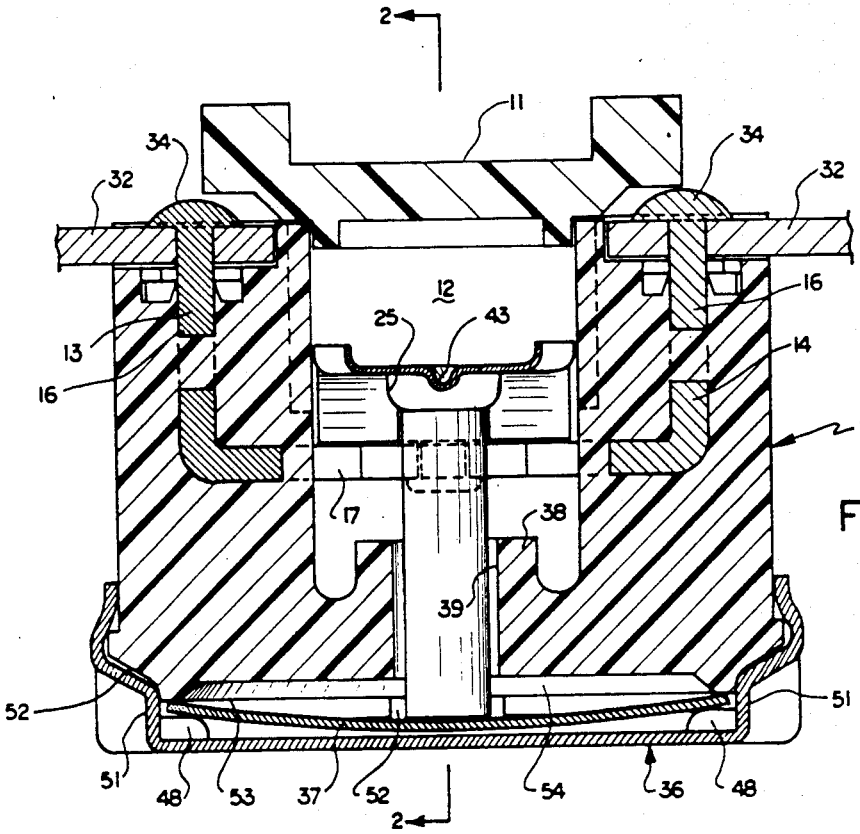
FIG. 1 is a side elevation in longitudinal section illustrating an assembled bimetal snap disc-operated device in accordance with a preferred embodiment of this invention.
Figure 2:
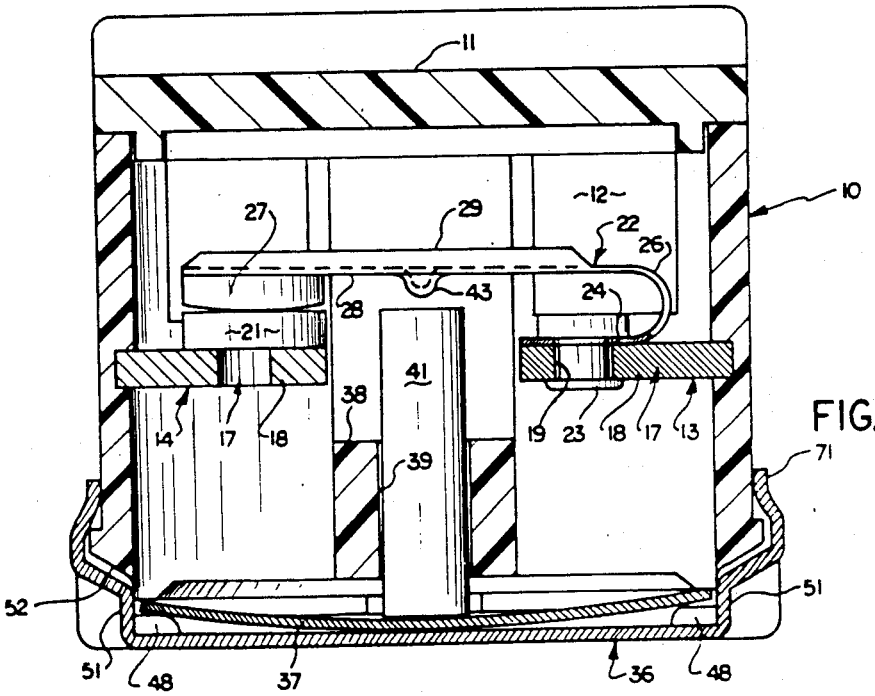
FIG. 2 is a longitudinal section, taken generally along line 2—2 of FIG. 1.
Figure 4:
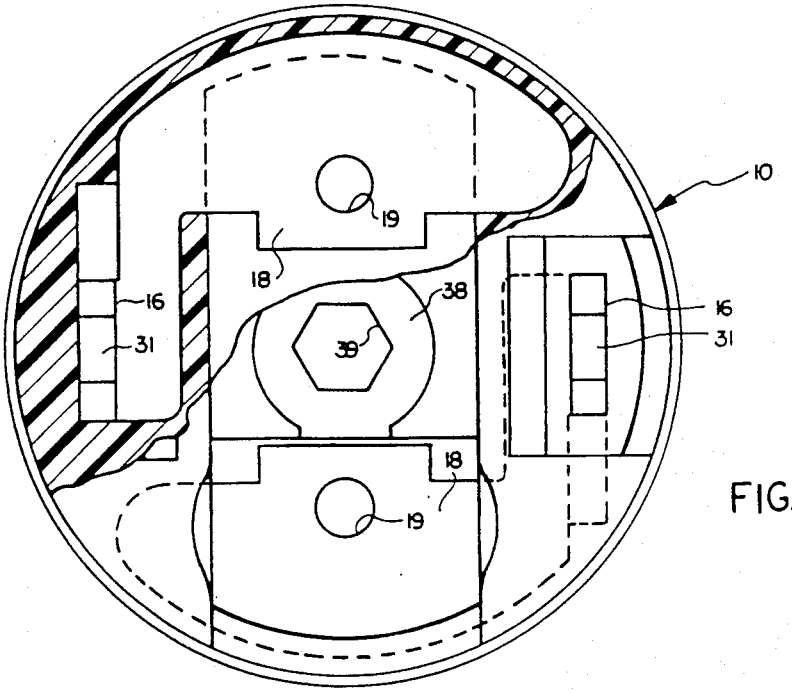
FIG. 4 is another plan view of the device, partially in section prior to the installation of the terminals and contacts, illustrating the manner in which the contact supports are secured in the body.

The general structure of the thermostat incorporating the present invention is best illustrated in FIGS. 1 through 4. The thermostat includes a molded body 10 which is generally cylindrical in shape and is closed at its upper end by a cover member 11. The body 10 and the cover 11 are preferably molded from a thermoplastic material such as a polyphenylene sulfide. Enclosed within the body 10 and cover 11 is a switch cavity 12. Embedded within the body 10 are two contact support elements 13 and 14 which are identical in structure. Each contact support includes an upstanding portion 16 (best illustrated in FIG. 8) and a horizontally extending portion 17. A substantial part of the upstanding portion 16 and a substantial part of the horizontal portion are embedded within the material of the body 10. As best illustrated in FIGS. 2 and 4 each of the contact supports provides a horizontal bridging section 18 which bridges across the switch cavity 12 and provides an aperture 19.

As best illustrated in FIG. 2, a fixed contact 21 is welded onto the bridging portion 18 of the contact supports 14 and one end of a cantilever-mounted, movable support arm 22 is secured to the bridging portion 18 of the other contact support 13 by a rivet 23 extending through the aperture 19 therein.

The movable contact support arm is formed of a spring material, such as beryllium-copper, and extends outwardly from the rivet along a portion 24 to a reverse bend at 26. From the reverse bend at 26, a portion 28 of the support arm 22 extends diametrically across the switch cavity and supports at its free end a movable contact 27. The diametrical portion 28 is formed with stiffening ribs 29 so that such portion does not flex.

With this arrangement, the principal spring action occurs along the reverse bend 26 and the diametrical portion 28, because of the stiffening ribs, does not flex to any material extent during normal operation of the switch. The arm 22, as discussed in greater detail below, is shaped to normally maintain the movable contacts 27 in engagement with the fixed contact 21 to provide a normally closed switch.

Figure 8:
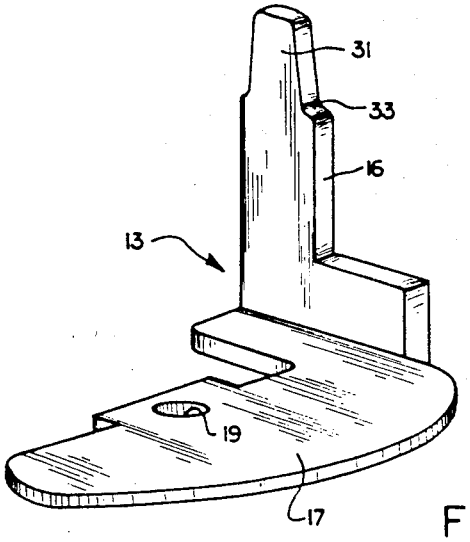
FIG. 8 is an enlarged, perspective view of one of the contact supports, illustrating the structure thereof.

The upper ends of the vertical portions 16 are provided with a reduced width rivet extension 31, as illustrated in FIG. 8, which is riveted over associated terminals 32 at the completion of the assembly of the device and as discussed in greater detail below. The end 31 is tapered down to surface 33 so as to interfere with a rectangular hole in the terminal when the terminal is pressed into contact with plastic. Interference shaves some metal off the sides of the rivet portion, creating a shelf at the level of the plastic. Riveting of the end 31 to form a rivet head 34 holds the terminal tightly against the plastic while producing good metal-to-metal contact.

A sheet metal disc retaining cup 36 is mounted on the end of the body 10 remote from the cover 11 and supports therein a bimetal snap disc 37, which is formed with a shallow curvature to provide it with snap action. In the drawings, the curvature of the disc 37 is exaggerated for purposes of illustration.

The body 10 is provided with a lateral wall 38 providing a centrally located bumper guide opening 39, which is preferably formed with a hexagonal shape, as best illustrated in FIG. 4. Positioned in such guide opening is a cylindrical, elongated bumper 41 which extends at one end to the snap disc 37 and at its other end to a position adjacent to the spring arm 22. The spring arm 22 is formed with a dimple or lateral projection 43 which is engaged by the upper end of the bumper 41 when the disc snaps through to its opposite position of curvature to cause deflection of the spring arm 22 and movement of the movable contact 27 away from the fixed contact 21.

As illustrated, the dimple 43 is sized to provide a small amount of lost motion before the opposite ends of the bumper engage the spring arm dimple 43 and the snap disc so that the switch will be operated while the snap disc is in snap movement. It should be noted that the clearance providing this lost motion, although illustrated between the spring arm and the bumper 41, may exist at the other end of the bumper if the thermostat is turned upside-down.

Figure 5:
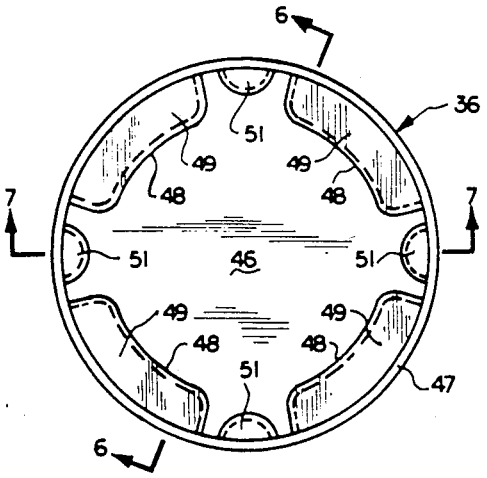
FIG. 5 is a plan view of the disc cup.
Figure 6:
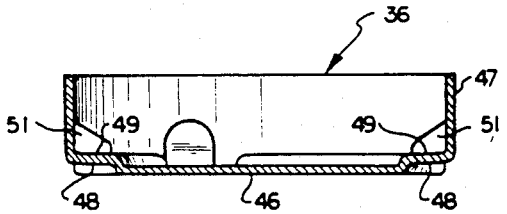
FIG. 6 is a section through the disc cup, taken generally along line 6—6 of FIG. 5.
Figure 7:
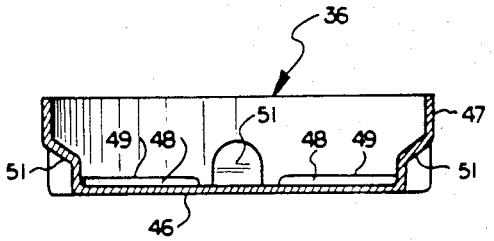
FIG. 7 is a section of the disc cup taken generally along line 7—7 of FIG. 5.

The disc cup 36 has a shape best illustrated in FIGS. 5 through 7. Such disc cup is usually die-formed from sheet aluminum and includes an end wall 46 and an upstanding, generally cylindrical side wall 47. The end wall 46 is deformed to provide at least three symmetrically arranged steps 48, which provide an upper, horizontally extending surface 49 spaced above and parallel to the plane of the end wall 46. In the illustrated embodiment, there are four such steps 48. The surfaces 49 cooperate to provide a disc seat which engages and supports the disc adjacent to its periphery and functions to axially locate the disc 37 within the cup. Because the central end wall portion 46 is recessed back from the surfaces 49, the center portion of the disc does not engage the disc cup even when in the downwardly curved position of FIGS. 1 and 2.

The disc cup also provides peripherally spaced, axially extending projections 51 which are again symmetrically arranged around the periphery of the disc. Here again, at least three axially extending projections 51 are provided, with four being provided in the illustrated embodiment. The axially extending projections provide an inner wall which is spaced from the corresponding walls of the other projections so as to closely fit theperiphery of the disc to radially locate the disc 37 within the cup. Sufficient clearance is provided, however, to ensure that the disc is not radially restrainedby the projections 51. The axial projections are spaced from the adjacent steps and external part of the plane of the disc seat. Therefore the disc does not engage at the outer edges of the steps or at the lower ends of the axial projections. This ensures that the disc is properly positioned by surfaces which are accurately formed. In fact the axial projections are spaced from the adjacent steps by the side walls 47 to ensure that no radii between them can engage the disc.

With this structure, the disc is axially and radially positioned within the cup without requiring a separate washer or disc seat ring. This disc cup configuration, which automatically positions the disc within the cup, is particularly desirable in the automated assembly of the device, since it properly positions the disc prior to the assembly of the cup and disc subassembly with the body assembly 10.

Figure 10:
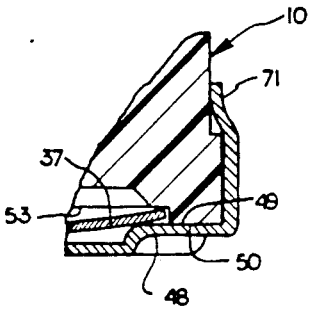
FIG. 10 is an enlarged fragmentary section illustrating the body structure which axially locates the disc cup and disc relative to the body.

The radial extent of the steps 48 is such that the upper surface 49 of the steps extends radially with respect to the center of the disc beyond the inner walls of the projections 51. As best illustrated in FIG. 10, the end of the body 10 is provided with a gaging end face 50 which engages the surface 49 of the step 48 beyond the edge of the disc 37 to axially locate the cup with respect to the body. The end wall of the body, however, is cut out at four locations 52 to receive the projections 51. Further, the body is formed with an end surface 53 which overlies the periphery of the disc to prevent the disc from moving in a direction toward the body in the event that the device is turned upside-down. Inwardly of the end wall 53, the body is formed with a shallow recess 54 to provide clearance for the disc when the disc snaps to its opposite position of curvature.

Figure 9:
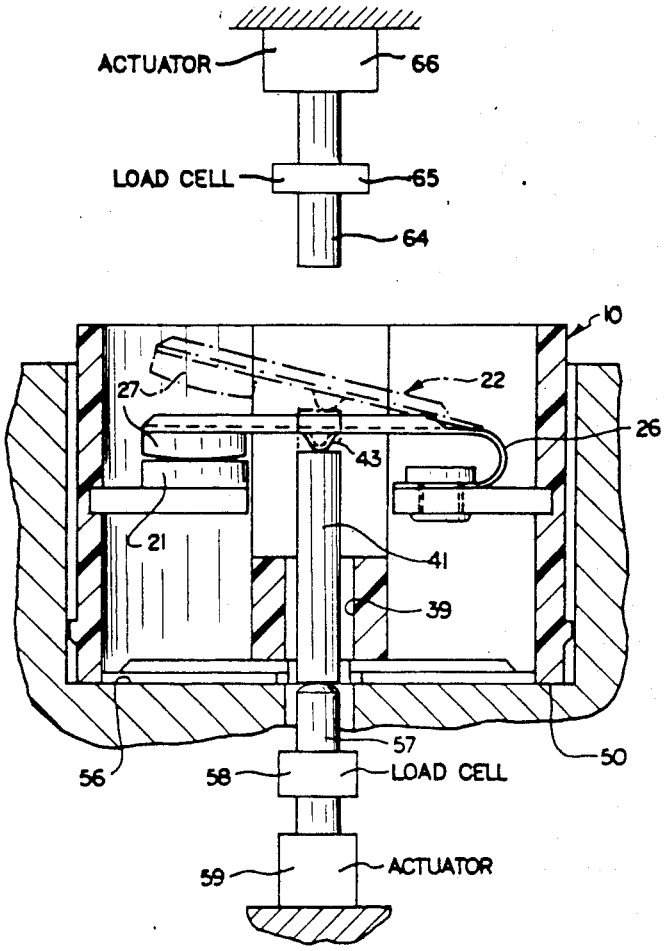
FIG. 9 is a schematic view of the apparatus for gaging and calibrating the spring force of the movable contact support arm.

FIG. 9 schematically illustrates the method and apparatus for automatically gaging and calibrating the spring force provided by the spring arm 22. Initially, the spring arm is formed with a sufficiently closed or tight reverse bend 26 to ensure that excessive spring force is provided. This results in an initial force between the two contacts 27 and 21 which exceeds the desired required force. Prior to the installation of the disc and cup, the body subassembly, with the switch elements mounted thereon, is positioned with the end wall 50 against a fixed surface 56 provided by the assembly apparatus.

The body subassembly is positioned so that a probe 57 provided by the gaging and calibration equipment engages the lower end of a bumper 41 positioned in the opening 39. The probe 57 is provided with a load cell schematically illustrated at 58 which determines the force of the spring on the bumper when the probe causes the bumper to move the contact to any predetermined position in which the two contacts are separated. A suitable actuator, such as the step motor 59, is provided to move the probe vertically with respect to the surface 56.

The method of performing the calibration of the force of the spring arm and the gaging of the device is as follows. The actuator 59 is operated to raise the probe 57, and in turn the bumper 41, until the upper end of the bumper engages the dimple 43. Initially, the spring arm 22 has a small amount of sag and as the actuator continues to raise the bumper, such sag is removed until a condition is reached in which there is essentially zero contact force between the two contacts 21 and 27. During this initial phase of movement of the dimple to remove the sag, the force on the load cell 58 is monitored with respect to movement to determine the sag spring rate of the spring arm 22.

At the instant the contacts separate, the spring rate drops drastically to the value of the spring rate of the cantilever movable spring arm 22. This drop in the spring rate is determined and in this way the position of the probe, when the contacts initially open, is determined and maintained in the control circuit of the gaging and calibration apparatus. When the gaging is completed, the lower end of the bumper will be in a predetermined position with respect to the reference surface 50 at the moment the contacts open. The difference between the probe position on initial opening and such predetermined position establishes the principal amount of gaging correction required.

The actuator 59 then continues to raise the probe and, through the bumper, moves the spring arm to the position or gap which exists in the completed device when the snap disc 37 first commences snap movement in the contact closing direction. Such position, which will exist in the finished device, is determined by the characteristics of the snap disc which will be installed in the thermostat and the position within the snap range in which it is desired to have the contacts actually close. It should be noted that the contact opening and closing should occur with snap movement in both directions and the gaging is selected to ensure that the proper amount of gap exists so that in the finished device, the contacts will open and close at some predetermined mid-position within the snap range of the disc.

When the proper gap is established, the force of the spring on the load cell is again determined. The amount such spring force exceeds the desired spring force in such position establishes the amount of spring force that must be removed to properly calibrate the spring force of the arm 22.

The gaging operation is then performed and during such operation the dimple is deformed the amount required to ensure that the lower end of the bumper 41 is in a predetermined position with respect to the gaging surface 50. To determine the amount of deformation of the dimple required, the displacement of the upper end of the probe at the moment the contacts open from the desired gaging position of the probe is established by the determination of the position of the probe at the moment the contacts were previously opened. Further, the amount of sag that will be removed from the properly gaged device when the arm force is properly calibrated is determined by the amount of force that will be removed from the arm during such calibration and the sag spring rate of the arm.

The actuator 59 is then operated to return the arm to some predetermined position which, for example, may be the position in which the contacts close. While the arm remains in such position by the probe 57, an upper probe 64 is lowered by its actuator 66 until it just engages the arm on the side opposite the probe to back up the arm. The determination of such contact is established by a load cell 65.

The actuator 59 is then again operated to raise the probe until the upper end of the probe is positioned in the desired gaging position. Such movement of the probe causes the bumper to deform the dimple 43 the required amount to properly compensate for all manufacturing tolerances and to ensure that precise gaging is achieved. The amount of gaging movement automatically compensates for any variations in the lengths of the bumpers 41 and all variations in the other elements of the assembly.

After retraction of the probe 64, the actuator 59 is then again operated to lift the arm to a raised position in which the desired contact gap exists and the force of the arm is again determined along with its deviation from the desired spring force. The actuator 59 then further raises the arm, which in this instance is to a position in which the arm 22 is deformed beyond its elastic limit so as to reduce the arm force for calibration of such force. The probe is then lowered to the position where the desired gap is established and the load on the load cell 59 is compared to the desired calibration force. If such force is the desired calibration force at such time, further calibration is terminated. On the other hand, if force is still greater than the desired calibration force, the actuator 59 is again recycled to again deform the arm beyond its elastic limit and further reduce the force of the arm in the calibration position. Such operation is continued until the desired calibration force is present when the arm is positioned in the desired gap position.

Suitable computer-type controls are provided for controlling the operation of the actuators to establish the above gaging and calibration operations in an automated manner. Such controls are known to persons skilled in the art, and are therefore not illustrated.

It should be understood that, although the above-described procedure for calibrating and gaging each device in an automated manner is preferred, variations in such procedure may be used within the broader scope ofthis invention. For example, the position of the probe when the contacts first open can be determined by an electrical control circuit connected to the contacts if desired, rather than by drop in the spring rate, which occurs the instant the contacts open. Further, if desired, the calibration can be performed before the gaging if so desired.

After the completion of the calibration and gaging operations, the switch body assembly is removed from the fixture and is assembled with a disc cup 36 and disc 37. Because the gaging operation automatically compensates for variations in the length of the bumper, it is not necessary to provide selective bumper assembly. After the disc cup and disc are installed, the disc cup is crimped at 71 to permanently mount the cup on the body, The assembly thus far described is completed before the installation of the terminals, and the device thus assembled is complete from a functioning standpoint. Because the spring force has been calibrated and the gaging is completed, the device is functionally complete and will operate accurately.

Subsequently, the particular type of terminal 32 which is required is assembled and riveted in place by upsetting the upper end of the projection 31 to form the rivet head. Because the terminal is strongly embedded in the material forming the body, the riveting can be performed without causing any damage to the assembled mechanism. Further, the manner in which the contact supports are embedded in the body provides sufficient rigidity so that if improper forces are applied to the terminal, causing bending thereof or the like, the contact supports will not be caused to move within the body and such forces applied to the terminals will therefore not affect the calibration or operation of the device. This anchoring of the contact supports within the body, so that they will not become loose even during the riveting or handling operations, is achieved by providing a substantial area in the vertical portion 16 and a large surface area in the horizontal portion 17 anchored within the material of the body 10. Because a surface-to-surface contact is provided between the surface 50 and the adjacent portion of the disc cup, the riveting operation does not produce any distortion of the disc cup.

Figure 3:
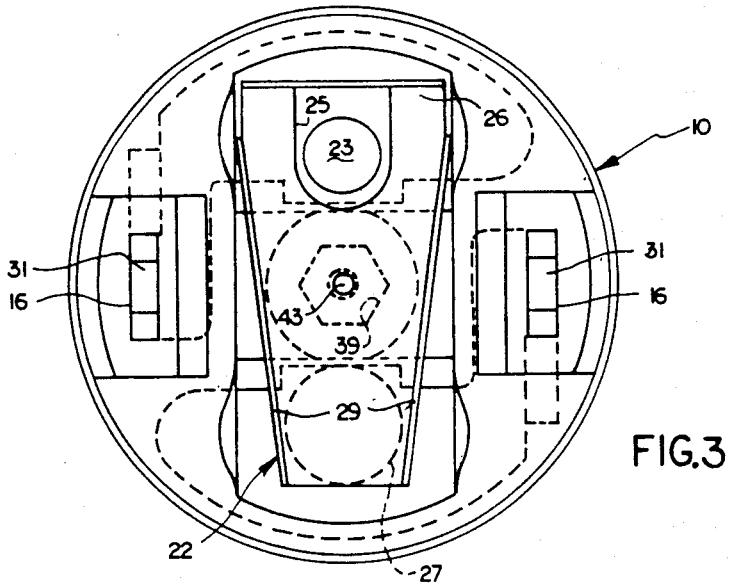
FIG. 3 is a plan view of the device illustrated in FIGS. 1 and 2, with the cover and terminals removed for purposes of illustration.

Further, it should be noted that only a relatively small portion required for access during the assembling, welding, and riveting operations of the contact supports is clear of the body material. As illustrated best in FIG. 2, however, the body is formed so that full access is provided both above and below the contact supports to permit proper welding of the fixed contact on the associated support and riveting of the spring arm 22 on its associated support. As illustrated in FIG. 3, the spring arm is provided with an opening 25 above the rivet 23 through which the rivet is fed and backed up during the riveting operation.

The automated assembly of the device is also facilitated by the fact that the body contact support assembly is symmetrical and the fixed contact and movable contact support arm can be connected to either of the contact supports. Consequently, the orientation of the body assembly within the assembling machine can be in either of two positions 180 degrees of rotation from each other. Establishment of one or the other of the two acceptable positions is easily accomplished because the body provides non-circular surfaces which can be used for positioning.

It is important that the spring force provided by the arm be accurately calibrated because variations in the force of the spring arm can produce variations in the operating temperatures of the device.

With the present invention, the cost savings of automation can be achieved in the production of quality devices.

Although the preferred embodiment of this invention has been shown and described, it should be understood that various modifications and rearrangements of the parts may be resorted to without departing from the scope of the invention as disclosed and claimed herein.

What is claimed is:

1. A method of gaging snap acting condition sensors which include a body, a switch mounted on said body providing a movable contact support, a snap acting condition sensor mounted on said body and a bumper operatively connecting said condition sensor and a lateral projection on said movable contact support, said method including providing said movable contact support with said lateral projection, positioning said movable contact support in a predetermined position with respect to said body, deforming said lateral projection through said bumper while maintaining said movable contact support in said predetermined position until said bumper has a predetermined spacing from a gaging surface on said body, and thereafter installing said condition sensor in a location determined by said gaging surface.

2. A method of gaging a snap acting condition sensor which include a body, a switch mounted on said body providing a movable contact support, a snap acting condition sensor mounted on said body and a bumper operatively connecting said condition sensor and said movable contact support, said method including providing said movable contact support with a deformable portion engageable by said bumper, prior to mounting said condition sensor positioning a first tool on one side of said deformable portion, positioning a second tool on the opposite side of said deformable portion, and moving said first tool to a predetermined position relative to a gaging surface on said body and said second tool to a position in which said switch is in a predetermined condition of switch operation, said movement of said tools deforming said deformable portion until it is in a gaged position with respect to said gaging surface, and thereafter installing said condition sensor.

3. A method as set forth in claim 2, wherein said deformable portion is a lateral projection and said tools reduce the length of said lateral projection.

4. A method of gaging snap acting switching devices, including bodies with switches mounted thereon and providing movable contact supports and condition sensors operably connected by bumpers to open and close said switches in response to changes in sensed conditions, said method including providing said movable contacts with a deformable portion engageable by said bumpers, positioning said movable contacts in a predetermined position of switch operation, deforming said deformable portions until they are spaced a gaged distance from a gaging surface on said bodies, and assembling said condition sensors on said bodies with said condition sensors positioned with respect to said gaging surface and said bumpers having a length corresponding to said gaged distance.

* * * * *